US008325964B2

(12) United States Patent
Weisman

(10) Patent No.: US 8,325,964 B2
(45) Date of Patent: Dec. 4, 2012

(54) METHOD AND SYSTEM FOR BONE CONDUCTION SOUND PROPAGATION

(75) Inventor: David Weisman, Kfar Saba (IL)

(73) Assignee: DSP Group Ltd., Herzliya (IL)

( * ) Notice: Subject to any disclaimer, the term of this patent is extended or adjusted under 35 U.S.C. 154(b) by 352 days.

(21) Appl. No.: 12/293,441

(22) PCT Filed: Mar. 19, 2007

(86) PCT No.: PCT/IL2007/000351

§ 371 (c)(1),
(2), (4) Date: Aug. 3, 2009

(87) PCT Pub. No.: WO2007/107985

PCT Pub. Date: Sep. 27, 2007

(65) Prior Publication Data

US 2009/0304210 A1 Dec. 10, 2009

(51) Int. Cl.
*H04R 25/00* (2006.01)

(52) U.S. Cl. ..... 381/380; 381/326; 381/151

(58) Field of Classification Search ..... 381/312, 381/322, 326, 151, 370, 380
See application file for complete search history.

(56) References Cited

U.S. PATENT DOCUMENTS

| | | | | |
|---|---|---|---|---|
| 4,821,323 | A * | 4/1989 | Papiernik | 381/151 |
| 5,125,032 | A * | 6/1992 | Meister et al. | 381/151 |
| 5,323,468 | A * | 6/1994 | Bottesch | 381/151 |
| 6,456,721 | B1 * | 9/2002 | Fukuda | 381/380 |

* cited by examiner

*Primary Examiner* — Suhan Ni
(74) *Attorney, Agent, or Firm* — Reches Patents

(57) ABSTRACT

A wearable surround sound system, that includes: (a) a processor, adapted to receive input signals representative of requested audio signals to be heard by the user and in response to generate multiple output signals; and (b) multiple bone conduction speakers, coupled to the processor, adapted to convey the multiple output signals to at least one bone of a user; wherein the bone conduction speakers are arrayed so as to stimulate an encompassing sound perception of the use. A wearable ambient sound reduction system, that includes: (a) a microphone, adapted to detect an ambient sound signal; (b) a processor adapted to generate an output signal in response to the ambient sound signal; wherein the output signal, when conveyed to a bone of the user, reduces an affect that an ambient sound signal has upon the user; wherein the microphone is coupled to the processor; and (c) a bone conduction speaker, coupled to the processor, adapted to convey the output signal to a bone of a user.

10 Claims, 11 Drawing Sheets

METHOD AND SYSTEM FOR BONE CONDUCTION SOUND PROPAGATION

FIELD OF THE INVENTION

The invention relates to methods and systems that implement bone conduction.

BACKGROUND OF THE INVENTION

Human perception of sound is responsive of two types of vibrations: (a) air conducted vibrations; and (b) bone conducted vibrations.

Air conducted vibrations are picked up by the outer ear, and travel down the ear canal to the ear drum, where the vibration is converted into mechanical energy which passes into the middle ear, where the bones in this region, the malleus, incus, and stapes, receive this signal (wherein the stapes is covered in a fluid which acts as good transmitter between the bones of the middle ear and the inner ear). The signal is sent through the said fluid to the inner lining of the cochlea within the inner ear, wherein the cochlea is lined with minuscule hairs that extend back towards the auditory nerve. Some of the minuscule hairs become excited in response to the various frequencies of the signal, and the excitation creates an electrical impulse in the auditory nerve which is sent to the brain.

Bone conducted vibrations that are applied to the skull are converted to inner cranial vibrations, wherein it is noted that different parts of the skull offer different conductivity of such vibrations. In order for the sound to be percepted, it must be transduced into an electrical signal, thus, based on bone conducted hearing, the cranial vibrations directly stimulate the hairs of the cochlea, while bypassing the outer and middle ears completely (it is noted that since the skull itself vibrates, there is no need for an external receiver such as the pinnae to pick up the signal). Similarly to air conducted vibrations hearing, different minuscule hairs are excited in response to the frequency of the bone conducted vibrations, thus enabling the perception of different frequencies.

It is well known to any person skilled in the art that the conduction of sound waves through an aerial medium, as well as the detection of sound that is conducted in this manner, is very problematic in some situations.

Virtually in every environment, multitudinous sounds surround a user. In some environments, such as in parties with high volume amplifiers or in crowded locations, the environmental sounds are very powerful, whereas in other situations, less powerful environmental sound may actually trouble the user.

Significant ambient sound in the user's surroundings may cause the user a significant inconvenience. More over, it impedes both (a) the perception of requested sound by the user, whether the requested sound is in the user's surroundings or is provided to the user by a sound system, and (b) the detection of sound generated by the user, by a sound detecting system or a communication system.

These two difficulties present a considerable obstacle in the creation of an efficient two-way communication system that is suitable for noisy conditions. People who are in noisy environment, may use a headset that covers the ears to reduce the amount of undesired noise penetrating the external ear channel. Some use also special a headset that reduces the ambient noise electronically by using active noise cancellation techniques. Some simply try to reduce the noise by covering their ears with their hands.

Previous attempts to solve these problems by using bone conduction have withdrawn to what is known as 'half duplex communication systems', in which the user can either receive a requested audio signal, or transmit a user sound, but not simultaneously.

It is desirable to find reliable and simple means of communicating in noisy environments. It is further desirable to find reliable and simple means for stimulating a user's encompassing sound perception, by way of bone conduction.

SUMMARY OF THE INVENTION

A wearable surround sound system, that includes: (a) a processor, adapted to receive input signals representative of requested audio signals to be heard by the user and in response to generate multiple output signals; and (b) multiple bone conduction speakers, coupled to the processor, adapted to convey the multiple output signals to at least one bone of a user; wherein the bone conduction speakers are arrayed so as to stimulate an encompassing sound perception of the user.

A wearable ambient sound reduction system, that includes: (a) a microphone, adapted to detect an ambient sound signal; (b) a processor adapted to generate an output signal in response to the ambient sound signal; wherein the output signal, when conveyed to a bone of the user, reduces an affect that an ambient sound signal has upon the user; wherein the microphone is coupled to the processor; and (c) a bone conduction speaker, coupled to the processor, adapted to convey the output signal to a bone of a user.

A method for conveying surround sound to a user, that includes: (a) receiving input signals, representative of requested audio signals to be heard by the user; (b) generating multiple output signals, in response to the requested audio signals; and (c) conveying, by multiple bone conduction speakers, the output signals to at least one bone of a user; wherein the bone conduction speakers are arrayed so as to stimulate an encompassing sound perception of the user.

A method for ambient sound reduction by a wearable ambient sound reduction system, that includes: (a) detecting an ambient sound signal; (b) generating an output signal in response to the ambient sound signal; wherein the output signal, when conveyed to a bone of the user, reduces an affect that an ambient sound signal has on the user; and (c) conveying, by a bone conduction speaker that belongs to the system, the output signal to a bone of a user.

BRIEF DESCRIPTION OF THE DRAWINGS

The foregoing and other objects, features, and advantages of the present invention will become more apparent from the following detailed description when taken in conjunction with the accompanying drawings. In the drawings, similar reference characters denote similar elements throughout the different views, in which.

DETAILED DESCRIPTION OF THE DRAWINGS

Figure 1:
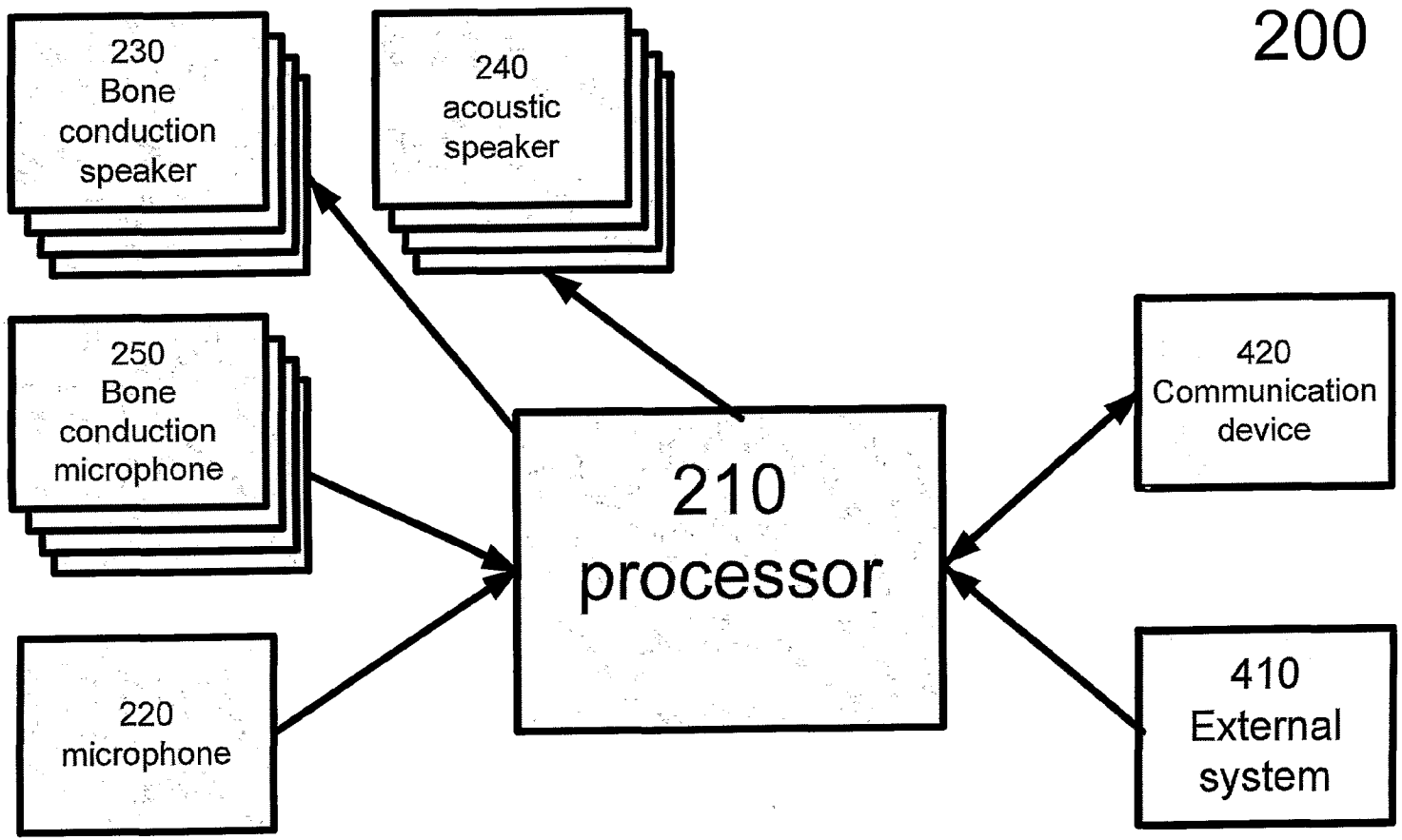
FIG. 1 is a block diagram of a wearable ambient sound reduction system, according to an embodiment of the invention.

FIG. 1 is a block diagram of system 200, which is a wearable ambient sound reduction system, according to an embodiment of the invention. System 200 includes: (a) microphone 220, which is adapted to detect an ambient sound signal; (b) processor 210 that is connected to microphone 220 and which is adapted to generate an output signal in response to the ambient sound signal, wherein the output signal, when conveyed to a bone of the user, reduces an affect that an ambient sound signal has upon the user; and (c) bone conduction speaker 230 that is connected processor 210 and is adapted to convey the output signal to a bone of a user.

It is noted that conventionally, processor 210 includes both hardware and software components.

Figure 7A:
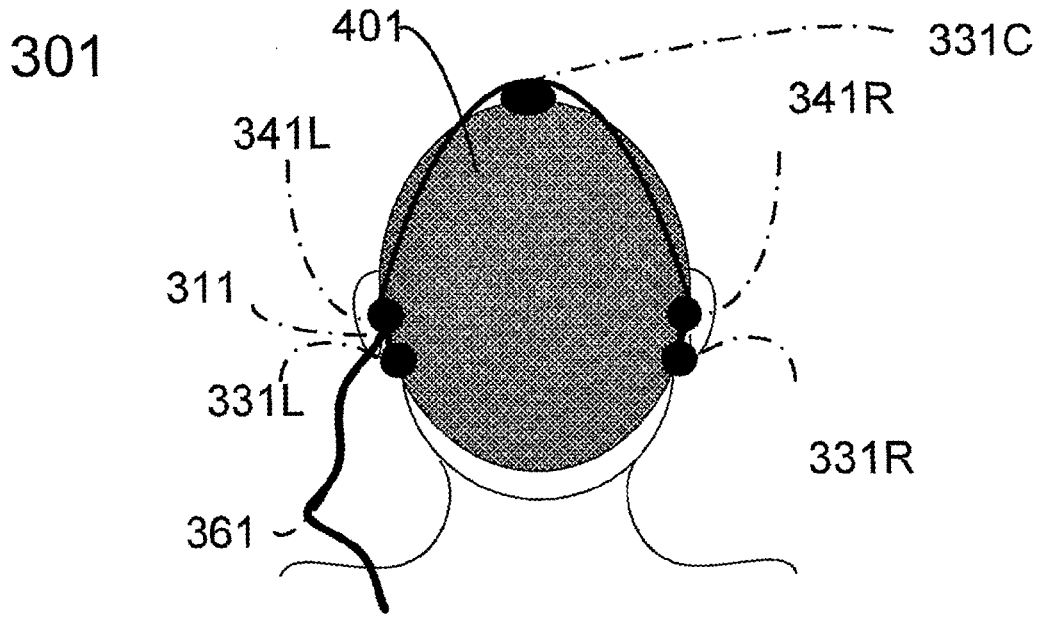
FIGS. 7*a* and 7*b* illustrates side view and a back view of a wearable surround system worn by a user, according to an embodiment of the invention.
Figure 7B:
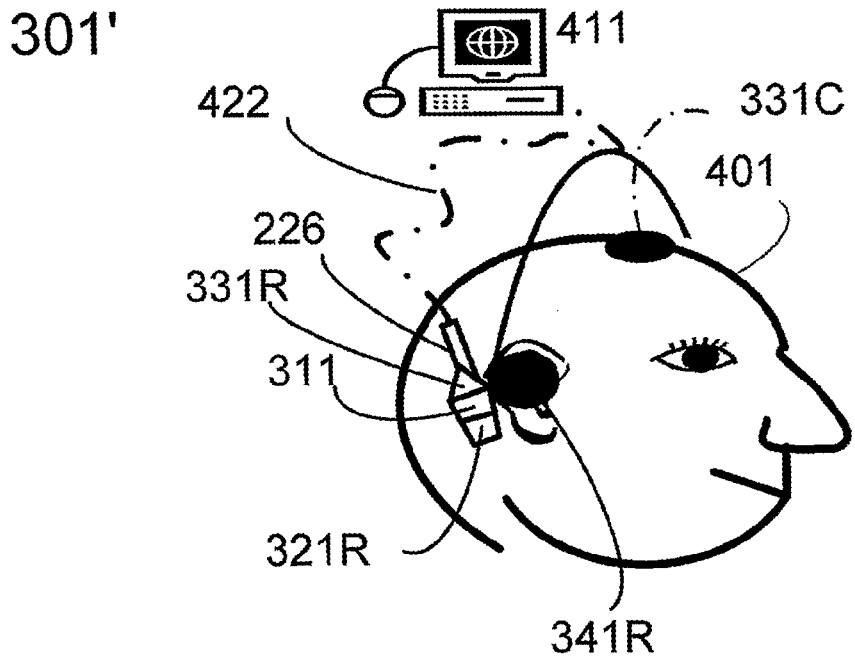

According to an embodiment of the invention, processor 210, microphone 220 and bone conduction speaker 230 are assembled on a wearable headgear (not shown; embodiments of similar headgear are illustrated in FIGS. 7*a* and 7*b*), which is designed so as to facilitate: (a) more affective ambient sound reduction; and (b) durably comfortable wearing by the user. According to an embodiment of the invention, the wearable headgear is adapted to be easily adjusted by the user, to enhance both the affective ambient sound reduction and the comfort of use of system 200. It is noted that according to other embodiments of the invention, processor 210, microphone 220 and bone conduction speaker 230 are assembled on one or more dedicated wearable devices, which may or may not include a headgear. It is noted that some of the components of system 200 according to a different embodiment of the invention may or may not be assembled on either the headgear or other wearable devices herein described.

According to an embodiment of the invention, system 200 includes multiple microphones 220, wherein each microphone 220 is adapted to autonomously detect an ambient sound signal; wherein processor 210 is adapted to receive different ambient sound signals from different microphones 220.

According to an embodiment of the invention, system 200 includes multiple bone conduction speakers, wherein processor 210 is adapted to generate one or more output signals and to provide each output signal to one or more of bone conduction speakers 230.

It is noted that different bone conduction speakers may be placed so as to convey the output signals to bones in different body parts of the user. Conveniently, at least some of the bone conductivity speakers are placed so as to convey the output signal components to the user's skull bones.

According to an embodiment of the invention that includes multiple microphones 220 and multiple bone conduction speakers 230, each microphone 220 is associated with one or more bone conduction speakers 230, in order to generate a different output signal for different bone conduction speakers 230, according to the respective ambient sound signals, detected by the microphones 220 that are associated with each bone conduction speaker 230.

According to an embodiment of the invention that includes multiple bone conduction speakers 230, system 200 includes multiple processor 210 that are connected to the different bone conductivity speakers 230, wherein each processor 210 is adapted to generate one or more output signals to be conveyed to multiple bones of the user by different bone conduction speakers 230.

According to an embodiment of the invention, system 200 is a concealable compact system, adapted to be worn by a user, conveniently behind at least one of the ears though not necessarily so, in a discreet manner as to be almost inconspicuous.

According to an embodiment of the invention, processor 210 is adapted to generate the output signal in response to an allowed ambient volume level. Conveniently, the allowed ambient volume level is determined by the user, but not necessarily so.

In some situations, the user may wish only to partially reduce the affect that the ambient sound has on himself (i.e. to dampen surrounding sound or noise to the allowed ambient volume level). Conveniently, the output signal correlates only to ambient sound signals that are louder than the allowed ambient volume level, so as to quieten said signals to a level in which they comply with the allowed ambient volume level.

According to an embodiment of the invention, processor 210 is further adapted to generate the output signal by respectively reducing the amplitude of all or most frequencies of the ambient sound signal, in response to the allowed ambient volume level.

According to an embodiment of the invention, processor 210 is adapted to generate the output signal in response to an ambient volume audio filter, such as a high pass filter, low pass filter, band pass filter, band stop filter and so forth. The generating of the output signal in response to the ambient volume audio filter is useful, by way of example only and not intending to limit the scope of the invention in any way, in situations in which the ambient sound includes sound that is arriving from one or more noise producers, characterized by a limited band of frequencies.

According to an embodiment of the invention, processor 210 is adapted to generate the output signal in response to an output audio volume filter, which is useful, by way of example only and not intending to limit the scope of the invention in any way, in order to provide the user with a certain sound experience (such as resembling a rock music sound scheme, classical music sound scheme, movie theatre sound scheme, and so forth).

According to an embodiment of the invention, the output volume audio filter is used in order to correct a perception distortion, derived from different conduction profiles of bone conducted and of air conducted vibrations hearing. As an example only, and not intending to limit the scope of the invention in any way, it is known to any person skilled in the art that low frequencies are transmitted better by bones then higher frequencies, thus leading for the perception of sound by the user as having a much lower pitch than it truly has, a problem which could be mended by a dedicated correction filter.

According to an embodiment of the invention, processor 210 is adapted to generate an output signal component out of the at least one output signal components of the output signal in response to a direction of the ambient sound signal. According to an embodiment of the invention, microphone 220 is an adaptable directional microphone that facilitates an easy change of the detection direction of ambient sound signals by the user. In some situations, it is desirable to reduce only a portion of the ambient sound that arrives to the user from one or more specific directions, such as to reduce sound that is arriving from a specific noise producer while keeping sounds that are arriving from other directions unimpaired.

According to an embodiment of the invention that includes multiple microphones 220, at least some of the multiple microphones 220 form one or more groups of microphones (not denoted) that facilitates the detection of ambient sound that arrives to the user from one or more specific direction without moving system 200, by applying a different phase shift to the sound signal detected by each of the microphones 220 of the group of microphones.

According to an embodiment of the invention, processor 210 is further adapted to receive input signals representative of requested audio signals to be heard by the user, and in response, to generate an output signal to the bone conductor speaker 230. As an example only, and not intending to limit the scope of the invention in any way, the requested audio signals may be music, speech or sounds generated by a computer program, and so forth. Conveniently, the input signals are received from an external system 410. As an example only, and not intending to limit the scope of the invention in any way, external system 410 may be a portable audio player, an audio system, a computer, and so forth. According to an embodiment of the invention, system 200 is adapted to generate by itself at least a portion of the output signals. Conveniently, the output signal generated by processor 210 according to the herein described embodiment, when conveyed to a user's bone, facilitates a perception of the requested audio signal while reducing the affect that the ambient sound signal has upon the user.

According to an embodiment of the invention, system 200 is adapted to receive the requested audio signals from communication device 420. As an example only, and not intending to limit the scope of the invention in any way, communication device 420 may be a cellular phone, a personal digital assistant, a portable two-way radio, and so forth.

According to an embodiment of the invention, system 200 is adapted to communicate with external systems 410 and/or with communications devices 420 wirelessly.

According to an embodiment of the invention, system 200 further includes bone conduction microphone 250 that is connected to processor 210 and is adapted to detect a user bone conducted signal; wherein the user bone conducted signal is a bone conduction signal that vibrates a sampled bone of the user. Conveniently, the user bone conducted signal is responsive to voices, and especially to speech, produced by the user. It is noted that on many occasions, the bone conduction signal is also responsive to additional vibrations of the sampled bone of the user, and specifically also to bone conduction signals applied to the sampled bone, such as the output signal applied to the sampled bone by bone conduction speaker 230.

According to the herein described embodiment of the invention, system 200 is further adapted to transmit a transmitted signal in response to the user bone conducted signal. According to an embodiment of the invention, system 200 is adapted to transmit the transmitted signal at least partially concurrently with the reception of the requested audio signals (a feature of communication systems conventionally referred to as full-duplex communication).

Conveniently, the transmitted signal is transmitted to an external system 410, which can be, though not necessarily so, a communication device 420, and especially the communication device 420 from which the requested audio signals are received.

It is noted that according to a previously discussed embodiment of the invention, system 200 is adapted to communicate with external systems 410 and/or with communications devices 420 wirelessly.

According to an embodiment of the invention, system 200 is further adapted to reduce echo effects from the transmitted signal, by subtracting a delayed signal from the transmitted signal that is responsive to the requested audio signal. According to an embodiment of the invention, processor 210 is further adapted to (a) determine a cancellation filter in response to a negligible user sound signal, and (b) reduce echo effects from the transmitted signal in response to the cancellation filter.

Figure 5A:
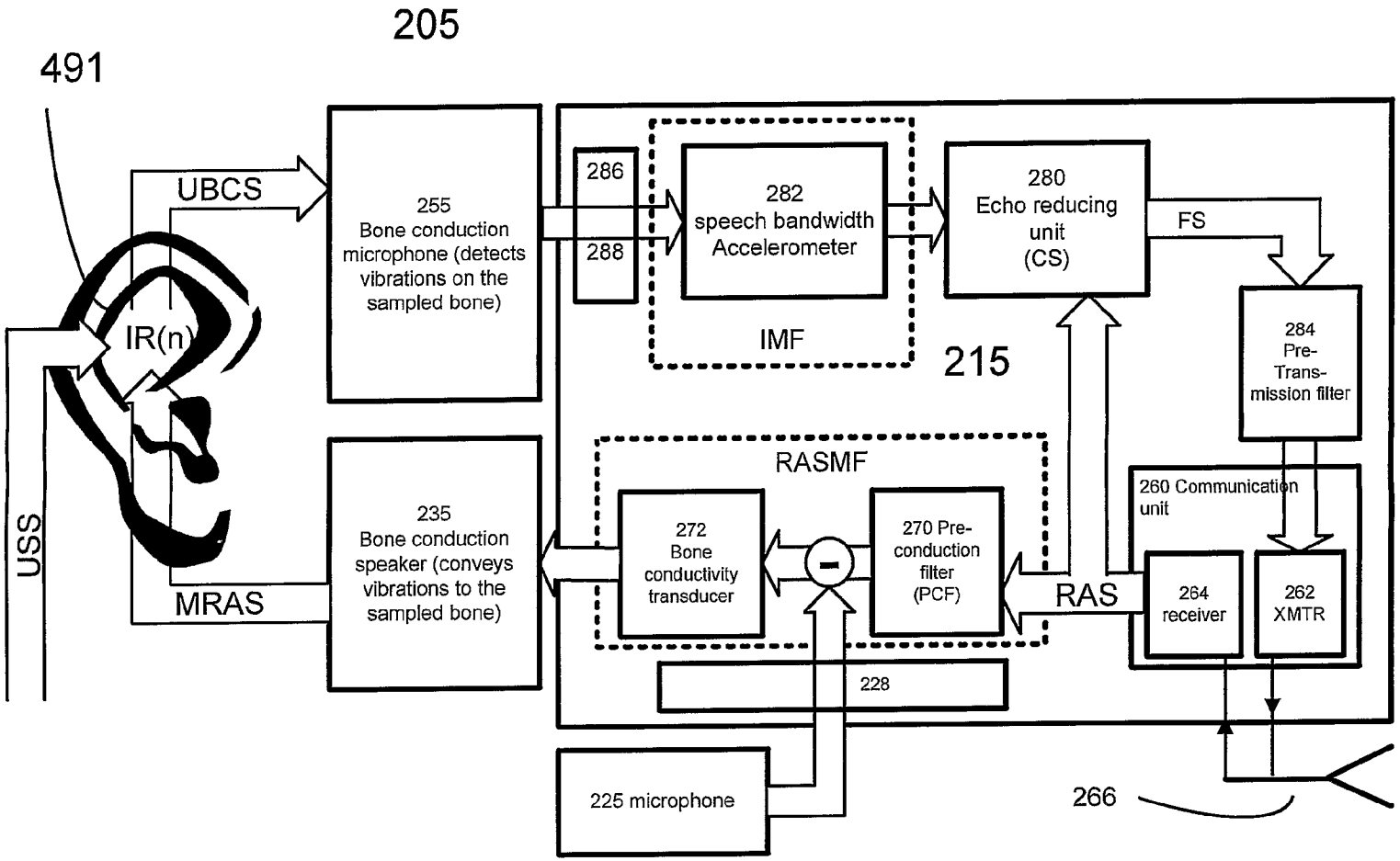
FIG. 5*a* is a block diagram of a wearable ambient sound reduction system, According to an embodiment of the invention.

According to an embodiment of the invention, processor 210 is adapted to determine the cancellation filter in response to a negligible user sound signal according to the detailed method specified in the detailed description of stage 543 of method 500, as well as in the description of FIG. 5*a*. It is noted that according to different embodiments of the invention, processor 210 is adapted to determine the cancellation filter in many other ways.

According to an embodiment of the invention, processor 210 is adapted to respond to a user request that is included in the user bone conducted signal.

According to different embodiments of the invention, system 200 is adapted to detect, process and convey either analog signals or digital signals. It is noted that according to some embodiments of the invention, system 200 is adapted for the handling of both analog and digital signals, wherein system 200 includes at least one component that is adapted to convert analog signal to a digital signal and/or to convert digital signal to an analog signal. According to an embodiment of the invention, processor 210 is adapted to convert analog signal to a digital signal and/or to convert digital signal to an analog signal. According to an embodiment of the invention, microphone 220 and/or bone conduction microphone 250 are adapted to convert an analog signal to a digital signal. According to an embodiment of the invention, bone conduction speaker 230 and/or acoustic speaker 240 are adapted to convert a digital signal to an analog signal. It is noted that according to different embodiments of the invention, other components of system 200 are adapted to convert an analog signal to a digital signal and/or to convert a digital signal to an analog signal.

According to an embodiment of the invention, system 200 implements additional methods of noise reduction, some of which are detailed in the literature, and are known and straightforwardly implemented by any person skilled in the art.

Figure 2:
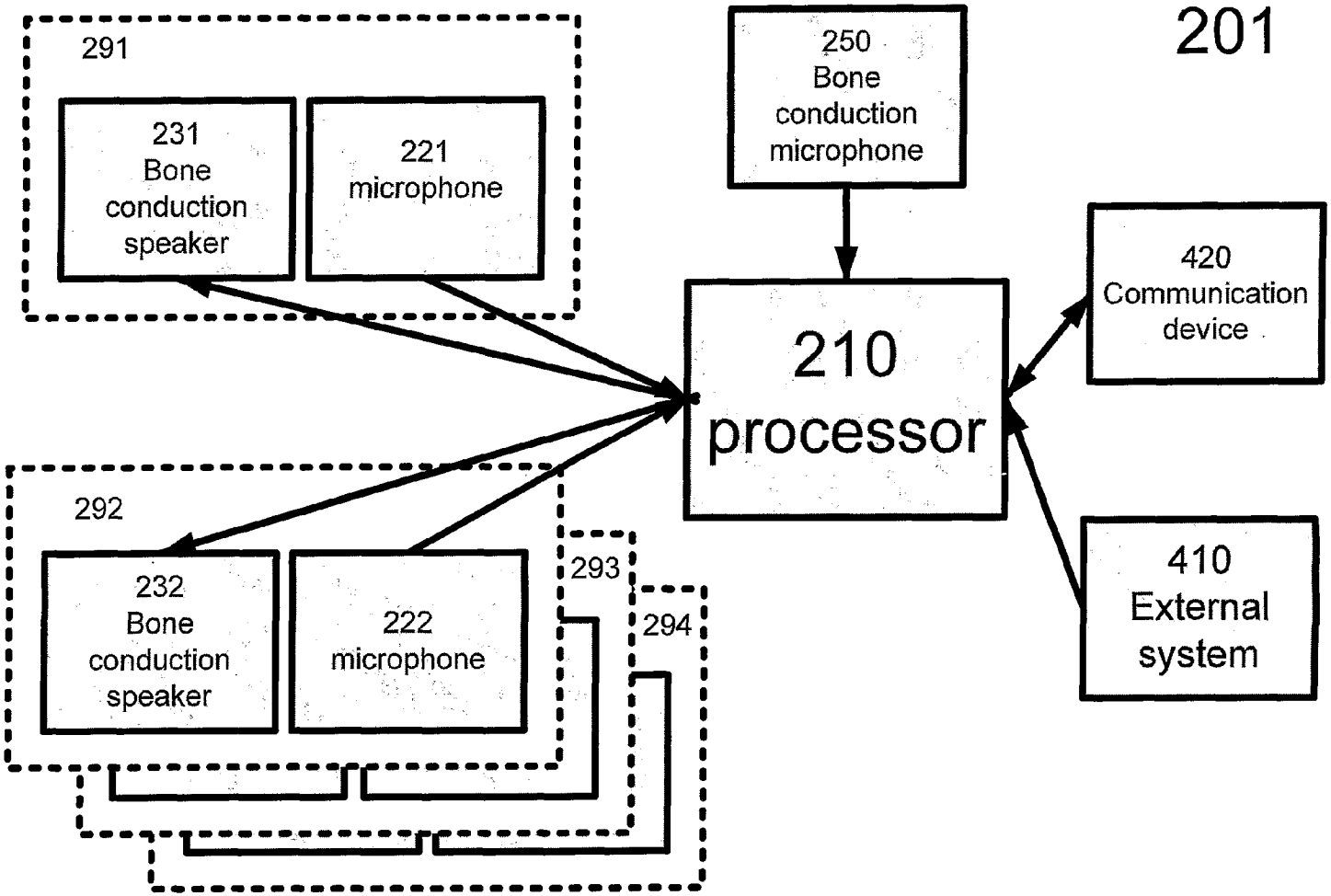
FIG. 2 is a block diagram of a wearable ambient sound reduction system, according to an embodiment of the invention.

FIG. 2 is a block diagram of system 201, which is a wearable ambient sound reduction system, according to an embodiment of the invention. System 201 is an embodiment of system 200, in which each microphone is associated to one of multiple bone conduction speakers, as to form multiple ambient sound reduction units, such as ambient sound reduction units 291, 292, 293 and 294. In the illustrated embodiment of the invention, ambient sound reduction unit 291 includes microphone 221 and bone conduction speaker 231, which are adapted to reduce ambient sound that is locally detected at the location of sound reduction unit 291. Similarly, ambient sound reduction unit 292 includes microphone 222 and bone conduction speaker 232, and so forth.

Figure 3A:
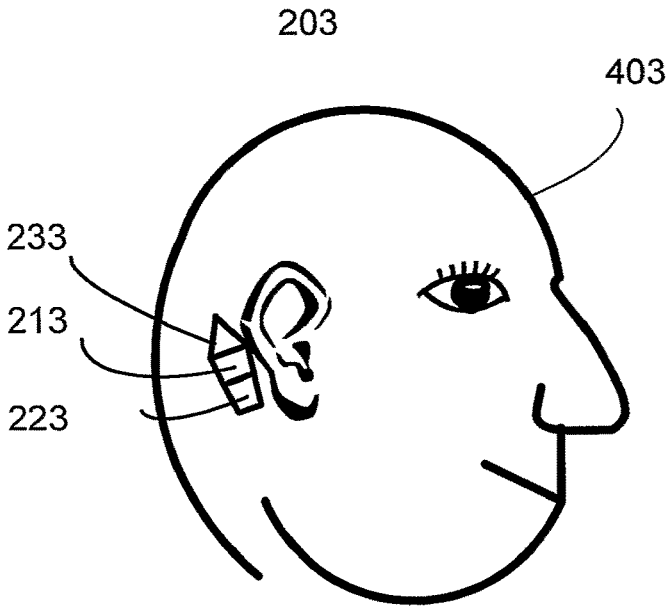
FIGS. 3*a*, 3*b* and 3*c* illustrate a side view and a back view of a wearable ambient sound reduction system wore by a user.

FIG. 3*a* illustrates a side view of wearable ambient sound reduction system 203 wore by a user, according to an embodiment of the invention. The main components of system 203 are processor 213, microphone 223 and bone conduction speaker 233. It is noted that different embodiments of system 203 implement similar features as different embodiments of system 200. Any person skilled in the art will immediately appreciate that system 203 is easily concealable behind the ear of user 403, adapted to be worn by user 403 in a discreet manner as to be almost inconspicuous. It is noted that according to some embodiments of the invention, system 203 is duplicated behind both ears of the user, wherein different embodiments include either one or two processors 213, and either one or two microphones 223.

Figure 3B:
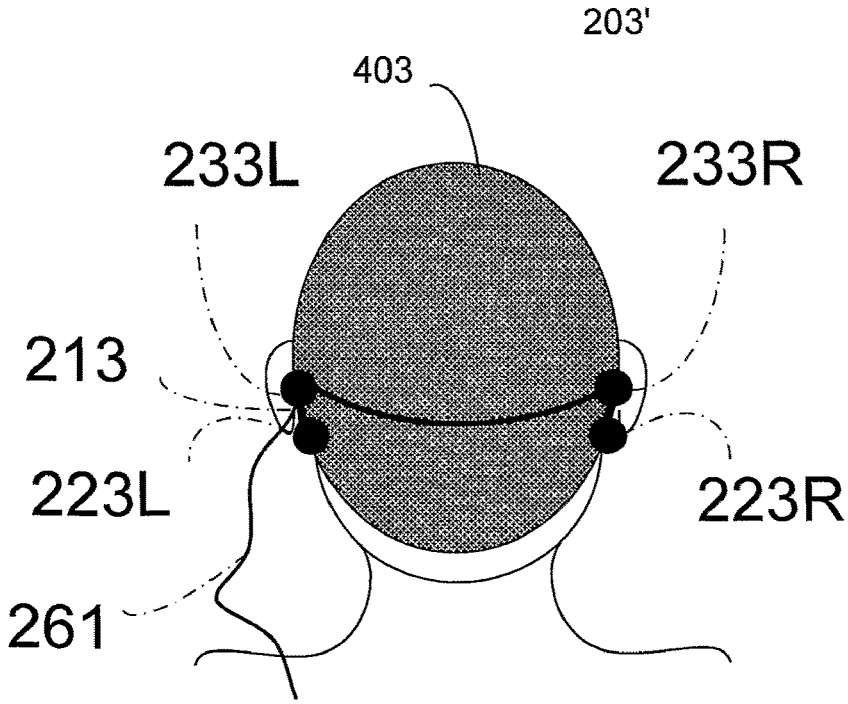

FIG. 3*b* illustrates a back view of wearable ambient sound reduction system 203' wore by a user, according to an embodiment of the invention. System 203' is an embodiment of system 203 of FIG. 3*a*. It is further noted that different embodiments of system 203' implement similar features as different embodiments of system 200. According to the embodiment of the invention illustrated in FIG. 3*b*, system 203' includes two bone conduction speakers, 233L and 233R, arrayed behind the left ear and the right ear of user 403, respectively. System 203' further includes two microphones 223L and 223R, wherein the ambient sound signal detected by microphone 223L is used by processor 213 to generate an output signal that is conveyed to user 403 by bone conduction speaker 233L, and the ambient sound signal detected by microphone 223R is used by processor 213 to generate an output signal that is conveyed to user 403 by bone conduction speaker 233R. System 203' is connected to an external system (not shown) or, according to another embodiment of the invention to a communication device (not shown) by data cable 261.

Figure 3C:
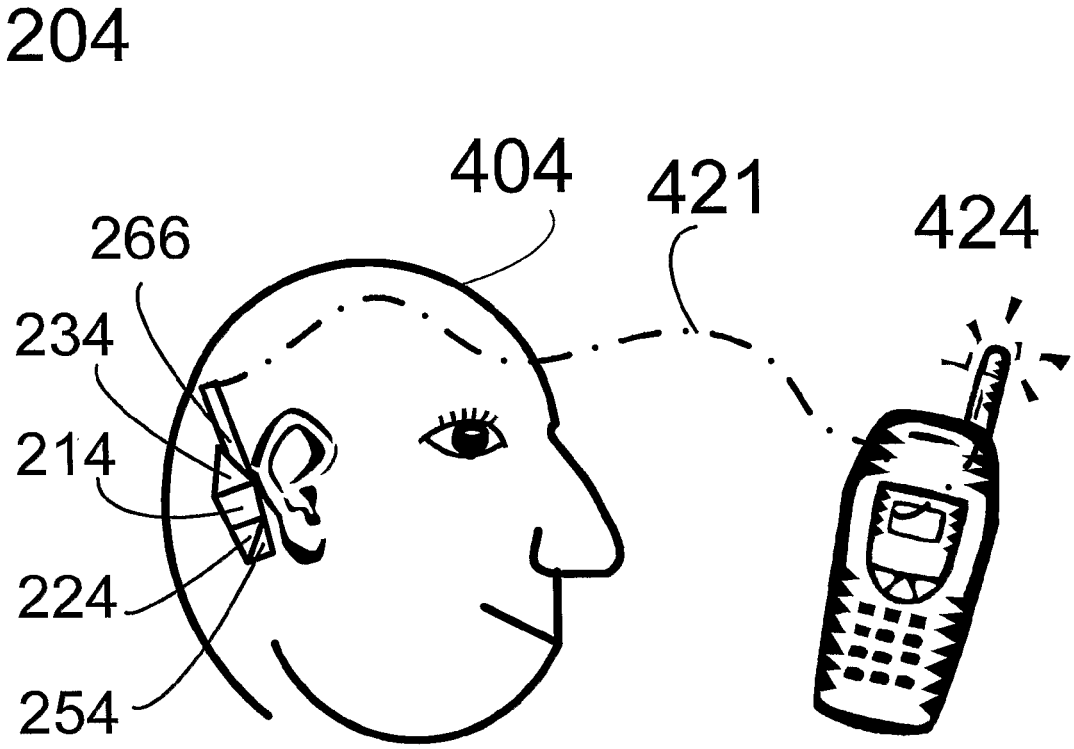

FIG. 3*c* illustrates a side view of wearable ambient sound reduction system 204 worn by a user, according to an embodiment of the invention. The main components of system 204 are processor 214, microphone 224 and bone conduction speaker 234. It is noted that different embodiments of system 204 implement similar features as different embodiments of system 200. Systems 204, and especially processor 214, are adapted to communicate with mobile phone 424; wherein processor 214 is further adapted to receive from mobile phone 424 input signals representative of requested audio signals to be heard by user 404 and in response to generate an output signal to bone conductor speaker 234. The receiving of the requested audio signal from mobile phone 424 is carried out by antenna 266, via wireless channel 421. Conveniently, the output signal generated by processor 214 according to the herein described embodiment, when conveyed to a bone of user 404, facilitates a perception of the requested audio signal while reducing an affect that the ambient sound signal has upon user 404.

As an example only, and not intending to limit the scope of the invention in any way, the requested audio signals may be music, speech, sounds generated by a computer program, and so forth.

According to an embodiment of the invention, system 204 further includes bone conduction microphone 254, that is connected to processor 214 and is adapted to detect user 404 bone conducted signal that is responsive to vibrations of a sampled bone of user 404. Conveniently, user 404 bone conducted signal is responsive to voices, especially to speech, produced by user 404. It is noted that on many occasions, the bone conduction signal is also responsive to additional vibrations of the sampled bone of user 404, and specifically also to bone conduction signals applied to the sampled bone, such as the output signal applied to the sampled bone by bone conduction speaker 230. According to an embodiment of the invention, system 204 is further adapted to transmit to mobile phone 424 a transmitted signal in response to user 404 bone conducted signal. According to an embodiment of the invention, system 204 is adapted to transmit the transmitted signal at least partially concurrently with the reception of the requested audio signals (a feature of communication systems conventionally referred to as full-duplex communication).

According to the illustrated embodiment of the invention, system 204 is adapted to communicate with mobile phone 424 wirelessly. According to another embodiment of the invention, system 204 is adapted to communicate with mobile phone by a wire connection (not shown), as in a standard mobile phone earphone. It is noted that according to some embodiments of the invention, system 204 is duplicated behind both ears of the user, wherein different embodiments include either one or two processors 214, and either one or two microphones 224.

Figure 4:
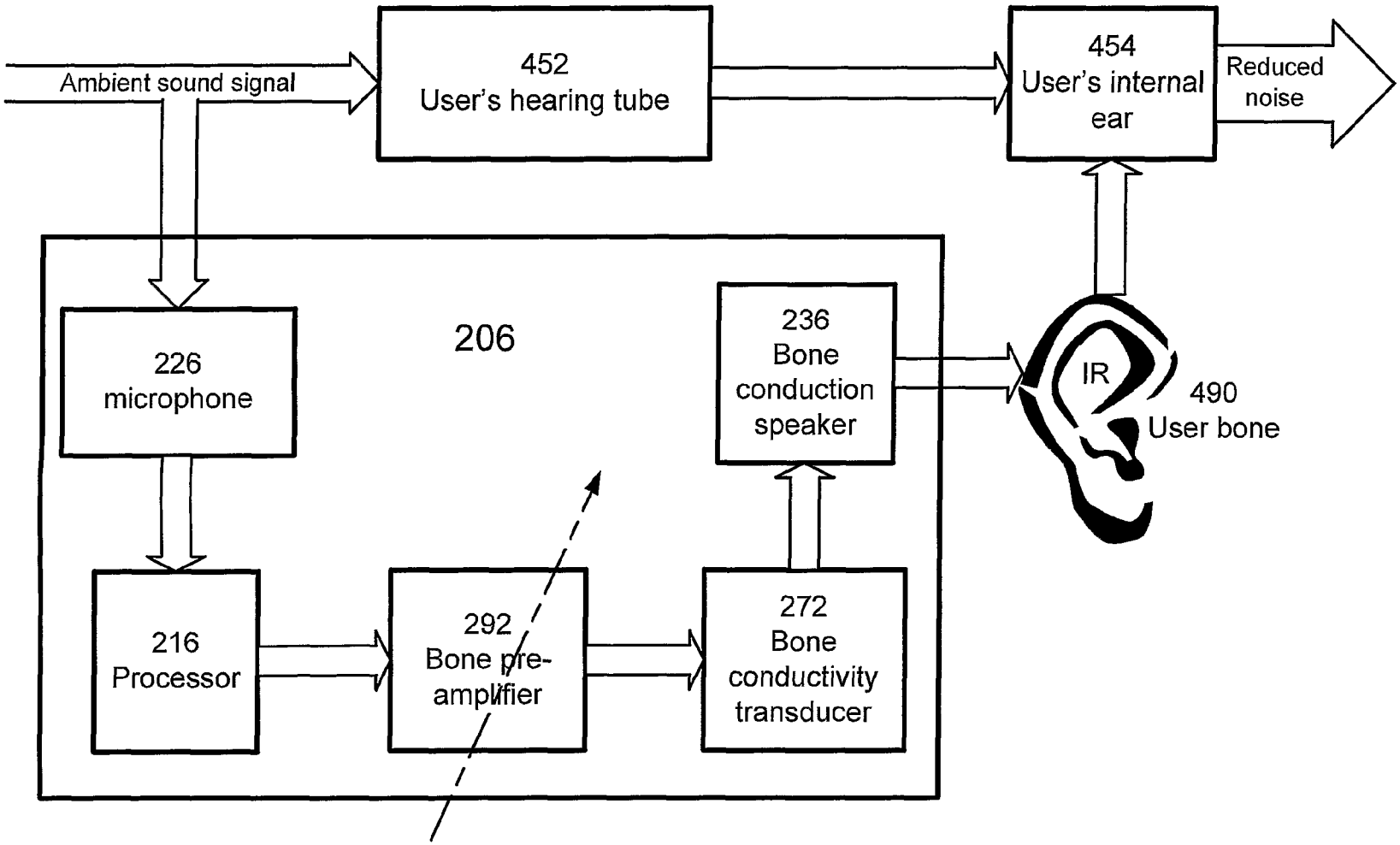
FIG. 4 is a block diagram of the noise reduction process carried out by a wearable ambient sound reduction system, according to an embodiment of the invention.

FIG. 4 is a block diagram of the noise reduction process carried out by system 206, which is a wearable ambient sound reduction system, according to an embodiment of the invention. System 206 includes: (a) microphone 226, (b) processor 216, and (c) bone conduction speaker 236; wherein all the components of system 206 are similar to the equivalent components specified lengthily at the description of system 200. Processor 216 generates an output signal in response to an ambient sound signal that is detected by microphone 226. The output signal is then conveyed to user bone 490 by bone conduction speaker 236 that is placed so as to convey the output signal to user bone 490. According to an embodiment of the invention, the output signal is manipulated by bone conductivity transducer 272 before it is provided to bone conduction speaker 236, so as to further adapt the output signal to be conveyed by way of bone conduction to user bone 490.

According to an embodiment of the invention, the output signal is amplified by bone preamplifier 292 before it is provided to bone conduction speaker 236. According to an embodiment of the invention, the amplifying carried out by bone preamplifier 292 is responsive to an allowed ambient volume level, which is conveniently though not necessarily determined by the user. It is noted that some of the ways in which the manipulation of the output signal is responsive to the allowed ambient volume level are detailed lengthily in the description of system 200 illustrated in FIG. 1.

It is noted that according to different embodiments of the invention, at least one of bone preamplifier 292 and bone conductivity transducer 272 is connected to processor 216.

Vibrations that are caused by the conveying of the output signal to bone 490 are conducted by the body of the user to one or both internal ears 454 of the user. Concurrently, the ambient sound signal is also conducted to internal ear 454 by the respective user's hearing tube 452. Following the teaching of the offered invention, the vibrations resulting from conveying the output signal reduce an affect that the ambient sound signal has upon internal ear 454.

In a notation in which: (a) ASS(n) denotes the ambient sound signal; (b) IES(n) denotes an internal ear signal, which is the signal that is detected in the internal ear; (c) UHF(n) denotes a user hearing filter; (d) NRF(n) denotes a noise reduction filter which is applied by processor 216; (e) BPAE (n) denotes a bone preamplifier equalizer which is applied to the output signal by bone preamplifier 292; (f) BCTF(n) denotes a bone conductivity transducer function of bone conductivity transducer 272; and (g) HBF(n) denotes a human bone filter of the user, and wherein the asterisk symbol signifies a convolution operation (e.g. f*g is a convolution of f with g), it is understood to any person skilled in the art that:

$$IES(n)=ASS(n)*UHF(n)-[ASS(n)*NRF(n)*BPAE(n)*BCTF(n)*HBF(n)] \quad (i)$$

In order that IES(n) will be zero, NRF(n) in the frequency domain must fulfill the following equation:

$$NRF(f)=UHF(f)/[BPAE(f)BCTF(f)HBF(f)] \quad (ii)$$

Wherein NRF(f), UHF(f), BPAE(f), BCTF(f), HBF(f) are the Fourier transform of NRF(n), UHF(n), BPAE(n), BCTF (n), HBF(n) respectively It is noted that according to an embodiment of the invention, in situation in which some electrical noise occurs, wherein the power spectrum of the electrical noise is denoted as ENPS(n), system 206 is adapted to implement Wiener filter, and explicitly, the noise reduction function (NRF(n)) must fulfill the following equation, wherein $\alpha$ is a constant:

$$NRF(f)=UHF(f)/[(BPAE(f)BCTF(n)HBF(f)+\alpha ENPS(n)] \quad (iii)$$

As will be immediately apprehended by any person skilled in the art.

As will be easily appreciated by any person skilled in the art, it is noted that whereas different embodiments of the invention are adapted to handle complicated forms of the ASS(n), IES(n), UHF(n), NRF(n), BPAE(n), BCTF(n), and HBF(n) functions, the following assumptions will be further explored, in order to clarify the invention: (1) the spectrum of BPAE(n)*BCTF(n) is flat; (2) HBF(n) is flat and generates delay of T seconds; and (3) UHF(n) is flat and generates a delay of Tu seconds. Conveniently, NRF(n) is designed to be flat with delay T1 sec. hence:

$$IES(n)=ASS(n-Tu)-ASS(n-T-T1); \quad (iv)$$

therefore, in the frequency domain w:

$$IES(w)=ASS(w)(e^{jw(Tu)}-e^{jw(T+T1)}); \quad (v)$$

The human ear is insensitive to phase, hence:

$$Abs(IES(w))=2Abs(ASS(w))(1-\cos(w(T+T1-Tu)); \text{ if:} \quad (vi)$$

$$T+T1=Tu \text{ or } T1\sim=Tu-T \text{ than:} \quad (vii)$$

$$IES(w)\sim=0=>IES(n)\sim=0 \quad (viii)$$

Namely the noise IES(n)=0, hence the noise is cancelled or reduced to a great extent in the internal ear.

It is known that sound propagation speed in bone is about 4080 m/sec and in air it is about 331 m/s. Assuming that the speech signal propagates in the ear about 5 cm, the difference between the time that the signal propagates via air and bone is 0.05/331−0.05/4080=0.139 ms.

This is a very important fact, because if this difference was negative it would be impossible to cancel the ambient noise signal that travels through external air path by using bone conductivity techniques.

As an example only, and not intending to limit the scope of the invention in any way, for 8 k samples/sec the difference between two consecutive samples is 0.125 ms which means the said delay is about 1 sample. From the analysis offered herein, it is clear for any person skilled in the art that in analog implementations of the invention, the group delay of the one or more noise reduction filters applied to the ambient noise signals must be less than 0.139 ms. It is noted that in digital implementations of the invention, all the calculations, including the analog to digital and digital to analog signal conversions, and including the data collection, must be finished within 1 sample, referring to the previously offered example of 8000 samples per second rate. This can be done if the digital filter is designed very carefully. Other embodiments of the invention use increased sampling rate, such as 44.1 kHz (which is offered merely as an example, and it is noted that multitudinous sampling rates could be implemented in different embodiments of the invention), which will provide, following the herein offered example, a duration of some five and a half samples to finish the calculation and to generate the right compensation delay.

FIG. 5*a* is a block diagram of wearable ambient sound reduction system 205, according to an embodiment of the invention. System 205 includes: (a) processor 215, (b) microphone 225, (c) bone conduction speaker 235, and (d) bone conduction microphone 255, wherein all the components of system 205 are similar to the equivalent components specified lengthily at the description of system 200.

Bone conduction speaker 235 is adapted to convey output signal to a bone 491 of a user, wherein the impulse response of bone 491 can be formulated as IR. Bone conduction microphone 255 is adapted to a detect user bone conducted signal (denoted as UBCS) that vibrates bone 491. The user bone conducted signal is responsive both to a user sound signal (denoted as USS) and to the manipulated requested audio signals (denoted as MRAS) which are the output signals that are conveyed to bone 491.

According to an embodiment of the invention, processor 215 includes multiple components that are adapted to carry out the generation of transmitted signals in response to the user bone conducted signal. As specified before, since the user bone conducted signal is responsive to the manipulated requested audio signals, an echo of the manipulated requested audio signals is included in the user bone conducted signal. System 205 is adapted to reduce the echo, thus transmitting a filtered signal (denoted as FS) to the communication device or to the external system, discussed above. According to an embodiment of the invention, the transmitting of the transmitted signal is carried out by communication unit 260, and specifically by transmitter 262, that is connected to antenna 266.

The manipulated requested audio signals that are applied to bone 491 are responsive to requested audio signals (denoted as RAS) received from the communication device or from the external system by receiver 264 that belongs to communication unit 260 via antenna 266.

According to an embodiment of the invention, the requested audio signals (denoted as RAS) are manipulated by one or more pre-conduction filtering units 270 and then converted to output signals which are adapted for bone conduction by bone conductivity transducer 272. The over all manipulation of the requested audio signals to the output signals can be formulated as an integrated requested audio signal manipulation filter (denoted as RASMF).

The filtering process is carried by echo reducing unit 280, wherein the manipulation to the manipulated user bone conduction signal applied by echo reducing unit 280 can be formulated as a cancellation filter (denoted as CS). According to an embodiment of the invention, the user bone conducted signal is manipulated by components such as speech bandwidth accelerator 282 before being provided to the echo reducing unit. The manipulations applied to the user bone conducted signal can be collectively formulated as an initial manipulation filter (denoted as IMF). Echo reducing unit 280 provides the filtered signal in response to: (a) the manipulated user bone conducted signal (denoted as MUCBS) and to the requested audio signal. It is noted that according to an embodiment of the invention, the filtered signal is further processed by components such as pre-transmission filter 284.

According to the notation offered above, wherein the asterisk symbol represents a convolution operation, $$FS(n)=MUBCS(n)-RAS(n)*CF(n) \quad \text{(ix)}$$

Wherein, $$MUBCS(n)=[USS(n)+MRAS(n)]*IR(n)*IMF(n); \text{ and} \quad \text{(x)}$$

$$MRAS(n)=RAS(n)*RASMF(n) \quad \text{(xi)}$$

It is desirable to determine by echo reducing unit 280 a cancellation filter CF(n) that will statistically minimize the differences between the filtered signal and the user sound signal, and following the same notation, according to an embodiment of the invention, the minimization is carried out so that the following expression is minimal (wherein E{ } presents the statistical average):

$$E\{[FS(n)-USS(n)]\hat{}2\}=E\{[MUBCS(n)-RAS(n)*CF(n)-USS(n)]\hat{}2\} \quad \text{(xii)}$$

As an example only intended to clarify the invention, and not intending to limit the scope of the invention in any way, presuming that the cancellation filter is stationary (i.e. is constant for different requested audio signals), the calculation of the cancellation filter is easily carried out if the user sound signal is negligible (i.e. USS(n)≈0), for expression (iv) than equals to:

$$E\{[MUBCS(n)-RAS(n)*CF(n)]\hat{}2\} \quad \text{(xiii)}$$

And equations (x) and (xii) are than reduced to:

$$MUBCS(n)=RAS(n)*RASMF(n)*IR(n)*IMF(n) \quad \text{(xiv)}$$

Hence, expression (xiii), that ought to be minimized, is equal to:

$$E\{[RAS(n)*RASMF(n)*IR(n)*IMF(n)-RAS(n)*CF(n)]\hat{}2\} \quad \text{(xv)}$$

The minimum of expression (xv) is obviously obtained when:

$$CF(n)=RASMF(n)*IR(n)*IMF(n) \quad \text{(xvi)}$$

Since RASMF(n) and IMF(n) are known filters of system 205, the only unknown parameter that is requested in order to determine the cancellation filter is the impulse response of sampled bone 491. When the user sound signal is negligible, from equation (xiv) it is easily understood by any person skilled in the art, that by applying one or more dedicated requested audio signal to bone 491, one can deduct the impulse response of bone 491 from the user bone conducted signal that is detected, and hence also the cancellation filter needed.

It is noted that it is not necessary for the user to maintain absolute silence during the determination of the cancellation filter. According to an embodiment of the invention, processor 215 is adapted to detect one or more silence periods, which are common in normal speech conversation (e.g. by energy detector 286 that detects energy of the user bone conducted signal). Once a silence period has been detected, the user sound signal can be eliminated for a short period (for example one that lasts few milliseconds), conveniently by shutting off bone conduction microphone 255 for the duration of the short period (e.g. by speech blocker 288).

According to an embodiment of the invention, in order to increase the accuracy of the calibration filter, processor 215 is adapted to repeat the determination of the cancellation filter few consecutive times. According to an embodiment of the invention, processor 215 is adapted to re-determine the cancellation filter from time to time in situations in which it facilitates an effective reduction of echoes (e.g. when the impulse response of bone 491 varies, such as, as an example only, when a relative movement between system 205 and bone 491 occurs).

According to an embodiment of the invention, energy detector 286 is further adapted to detect silence periods in the requested audio signal, thus facilitating power saving by system 205.

According to an embodiment of the invention, ambient sound signals that are detected by microphone 225 are processed by noise reduction filter 228 that belongs to processor 215, so as to reduce an affect that the ambient sound signal has upon the user when conveyed to bone 491. According to the described embodiment of the invention herein, processor 215 generates the output signal in response to the processed ambient sound reducing signal provided by noise reduction filter 228.

Figure 5B:
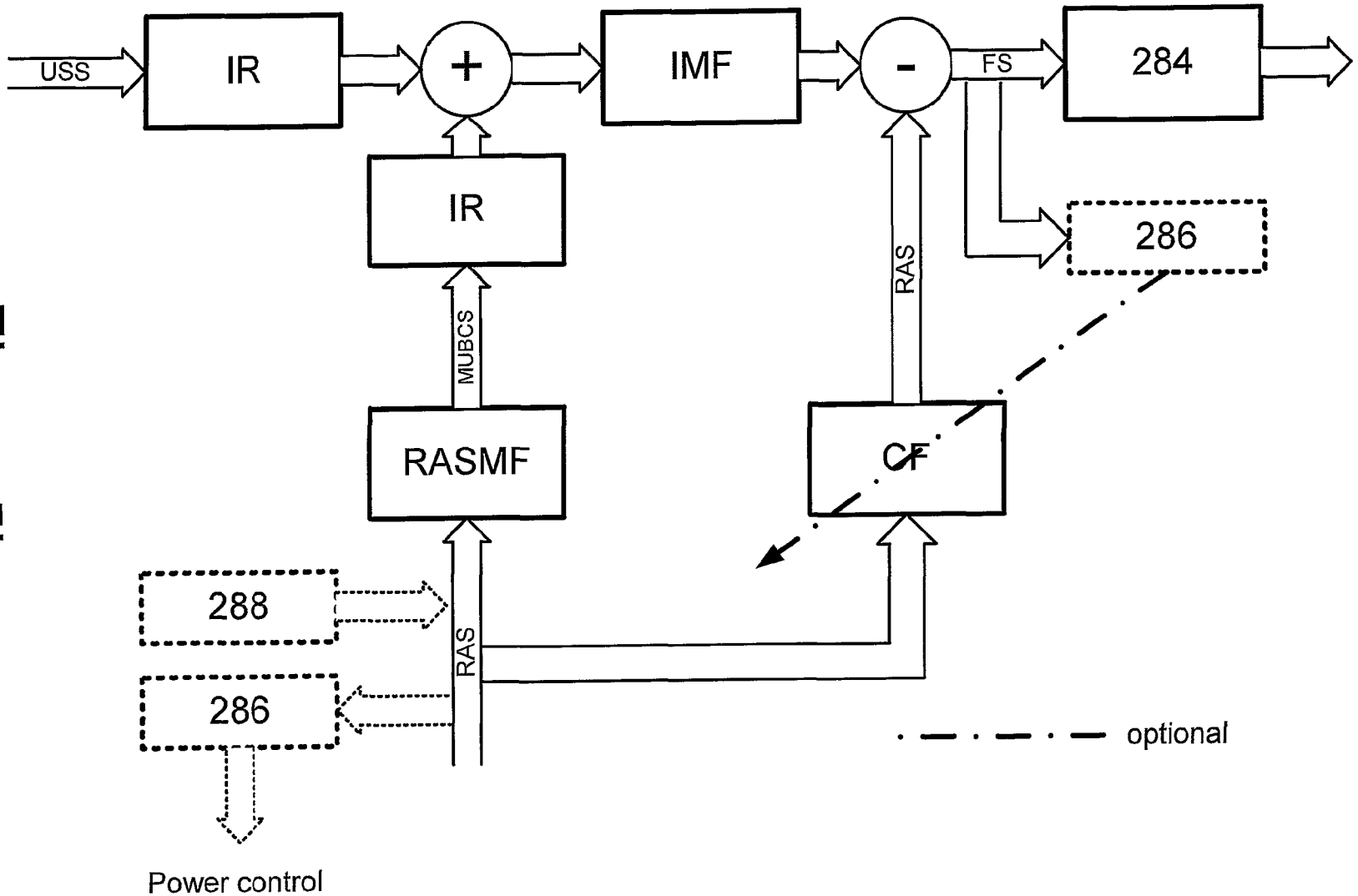
FIG. 5*b* is a block diagram of filtering and manipulating processes carried out by a wearable ambient sound reduction system, according to an embodiment of the invention.

FIG. 5*b* is a block diagram of filtering and manipulating processes carried out by system 205, according to an embodiment of the invention. It is noted that the diagram of filtering and manipulating processes carried out by system 205 is offered merely for clarification of the system, and that the processes described in the specification of FIG. 5*a*, and that all the notations of components and of processes of FIG. 5*b* are referring to components and processes specified at length in the description of FIG. 5*a*.

Figure 6:
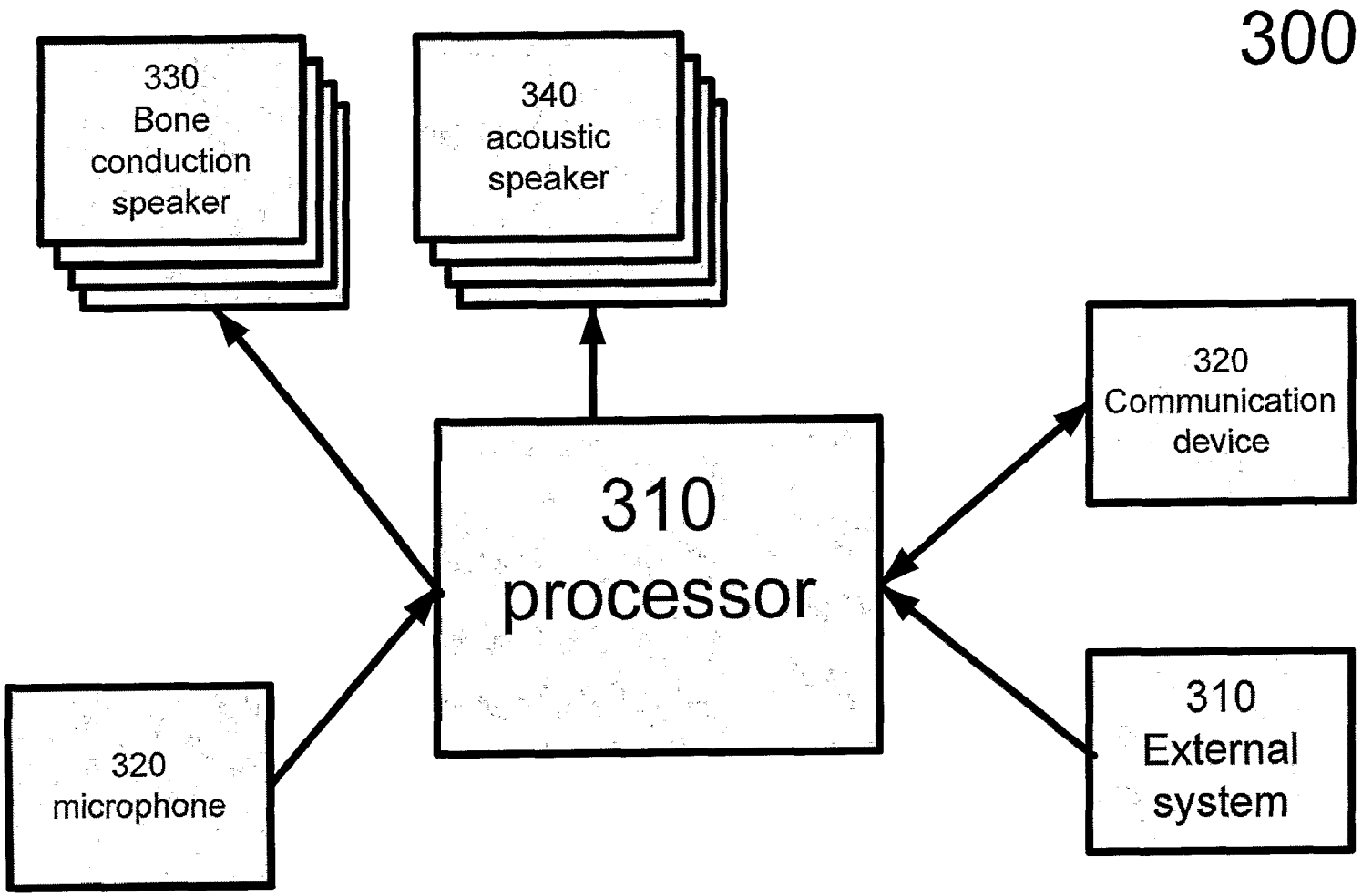
FIG. 6 is a block diagram of system 300, which is a wearable surround sound system, according to an embodiment of the invention.

FIG. 6 is a block diagram of system 300, which is a wearable surround sound system, according to an embodiment of the invention. System 300 includes processor 310 which is adapted: (a) to receive input signals representative of requested audio signals to be heard by the user, and in response, (b) to generate multiple output signals. Multiple bone conduction speakers 330, which are coupled to processor 310, are adapted to convey the multiple output signals to at least one bone of a user; wherein bone conduction speakers 330 are arrayed so as to stimulate an encompassing sound perception of the user.

It is noted that different bone conduction speakers may be placed so as to convey the output signals to bones in different body parts of the user. Conveniently, at least some of the bone conductivity speakers are placed so as to convey the output signal components to the user's skull bones.

As an example only, and not intending to limit the scope of the invention in any way, the requested audio signals may be music, speech, sounds generated by a computer program, and so forth. Conveniently, the requested audio signals are interrelated so as to represent surround sound. According to an embodiment of the invention, at least one output signal component is not interrelated with at least one other output signal component.

It is noted that conventionally, processor 310 includes both hardware and software components.

According to an embodiment of the invention, both processor 310 and the multiple bone conduction speakers 330 are assembled on a wearable headgear (not shown; embodiments of which are illustrated in FIGS. 7*a* and 7*b*), which is designed so as to facilitate: (a) the encompassing sound perception of the user; and (b) durably comfortable wearing by the user. According to an embodiment of the invention, the wearable headgear is adapted to be easily adjusted by the user, to enhance both the encompassing sound perception of the user and the comfort of use of system 300. It is noted that according to other embodiments of the invention, both processor 310 and the multiple bone conduction speakers 330 are assembled on one or more dedicated wearable devices, that may or may not include headgear. It is noted that some of the components of system 200 according to different embodiment of the invention may or may not be assembled on either the headgear or other wearable devices herein described.

According to an embodiment of the invention, system 300 includes one or more acoustic speakers 340, wherein the bone conduction speakers and the acoustic speakers are arrayed so as to stimulate an encompassing sound perception of the user, wherein, conveniently, acoustic speakers 340 are arrayed so as to convey sound to one or both ears of the user.

According to an embodiment of the invention, system 300 includes one or more microphones 320, which are coupled to processor 310 and are adapted to detect an ambient sound signal; wherein, processor 310 is further adapted to generate at least one output signal component in response to the ambient sound signal; wherein at least one output signal component, when conveyed to a bone of the user, reduces an affect of the ambient sound signal upon the user.

It is noted that different embodiments of system 300 implement different ambient sound reduction approaches, some of which are detailed in length in the description of system 200. Especially, according to an embodiment of the invention, system 300 includes an echo reduction unit (not shown, that is similar to echo reduction unit 280 of system 205).

According to an embodiment of the invention, processor 310 is adapted to generate at least one output signal component in response to a direction of the ambient sound signal. According to an embodiment of the invention, microphone 320 is an adaptable directional microphone that facilitates easy changing of the detection direction of ambient sound signals by the user. In some situations it is desirable to reduce only a portion of the ambient sound which arrives to the user from one or more specific direction, such as to reduce sound that is arriving from a specific noise producer while keeping sounds that are arriving from other directions unimpaired.

According to an embodiment of the invention that includes multiple microphones 320, at least some microphones 320 form one or more groups of microphones (not denoted) that facilitate the detection of ambient sound that arrives to the user from one or more specific direction without moving system 300, e.g. by applying a different phase shift to the sound signal, detected by each of the microphones 320 of the group of microphones.

According to an embodiment of the invention, processor 310 is adapted to generate the output signal in response to an allowed ambient volume level. Conveniently, the allowed ambient volume level is determined by the user, but not necessarily so.

In some situations, the user may wish only to partially reduce the affect that the ambient sound has on himself (i.e. to dampen surrounding sound or noise to the allowed ambient volume level). Conveniently, the output signal correlates only to ambient sound signals that are louder than the allowed ambient volume level, so as to quieten said signals to a level in which they comply with the allowed ambient volume level.

According to an embodiment of the invention, processor 310 is further adapted to generate the output signal by respectively reducing the amplitude of all or most frequencies of the ambient sound signal, in response to the allowed ambient volume level.

According to an embodiment of the invention, processor 310 is adapted to generate the output signal in response to an ambient volume audio filter, such as a high pass filter, low pass filter, band pass filter, band stop filter and so forth. The generating of the output signal in response to the ambient volume audio filter is useful, by way of example only and not intending to limit the scope of the invention in any way, in situations in which the ambient sound includes sound that is arriving from one or more noise producers, characterized by a limited band of frequencies.

According to an embodiment of the invention, processor 310 is adapted to generate the output signal in response to an output audio volume filter, which is useful, by way of example only and not intending to limit the scope of the invention in any way, in order to provide the user with a certain sound experience (such as resembling a rock music sound scheme, classical music sound scheme, movie theatre sound scheme, and so forth).

According to an embodiment of the invention, the output volume audio filter is used in order to correct a perception distortion, derived from different conduction profiles of bone conducted and of air conducted vibrations hearing. As an example only, and not intending to limit the scope of the invention in any way, it is known to any person skilled in the art that low frequencies are transmitted better by bones then higher frequencies, thus leading for the perception of sound by the user as having a much lower pitch than it truly has, a problem which could be mended by a dedicated correction filter.

According to different embodiments of the invention, system 300 is adapted to detect, process and convey signals which are either analog signals or digital signals. It is noted that according to some embodiments of the invention, system 300 is adapted for the handling of both analog and digital signals, wherein system 300 includes at least one component that is adapted to convert an analog signal to a digital signal and/or to convert a digital signal to an analog signal. According to an embodiment of the invention, processor 310 is adapted to convert analog signal to a digital signal and/or to convert a digital signal to an analog signal. According to an embodiment of the invention, microphone 320 is adapted to convert an analog signal to a digital signal. According to an embodiment of the invention, bone conduction speaker 330 and/or acoustic speaker 340 are adapted to convert a digital signal to an analog signal. It is noted that according to different embodiments of the invention, other components of system 300 are adapted to convert an analog signal to a digital signal and/or to convert a digital signal to an analog signal.

FIG. 7*a* illustrates a back view of wearable surround system 301 worn by user 401, according to an embodiment of the invention; wherein system 301 supports five channels surround sound. System 301 includes two bone conduction speakers 331L and 331R, that are placed behind the ears of user 401; (b) two acoustic speakers 341L and 341R that convey output signal components to the ears of user 401, and (c) central bone conduction speaker 331C that is placed near the forehead of user 401, or on another point on the head of user 401. It is noted that many other embodiments of the invention are capable of supporting five channels surround sound, whereas yet other embodiments of the invention support other surround sound standards, and any different numbers of channels. According to an embodiment of the invention that supports 5.1 surround sound channels, system 301 further includes an additional bone conduction speaker (not shown) that is adapted to perform as a subwoofer speaker, and is placed elsewhere on the head or on the body of user 401. According to an embodiment of the invention, system 301 receives the requested audio signal via data cable 361. It is noted that according to other embodiments of the invention, system 301 receives the requested audio signal wirelessly, or otherwise.

FIG. 7*b* illustrates a side view of wearable surround system 301' wore by user 401, according to an embodiment of the invention. FIG. 7*b* illustrates bone conduction speaker 331R, acoustic speakers 341R and 341C and processor 311 that where illustrated in FIG. 7*a*. System 301' differs from system 301 by including: (a) microphone 321R (and, according to an embodiment of the invention, also a user left-hand side microphone, not shown in the illustration), which is adapted to detect ambient sound signal the affect of which upon user 401 is to be reduced by processor 311; (b) antenna 226, that is adapted to receive the requested audio signal from an external system such as computer 411 by wireless connection 422. It is noted that according to different embodiments of the invention, system 301' is adapted to receive the requested audio signal from different external systems and/or communication devices. As an example only, and not intending to limit the scope of the invention in any way, the external system may be a portable audio player, an audio system, a mobile phone, a computer, and so forth. Conveniently the external system has surround sound capabilities, but not necessarily so.

Figure 8:
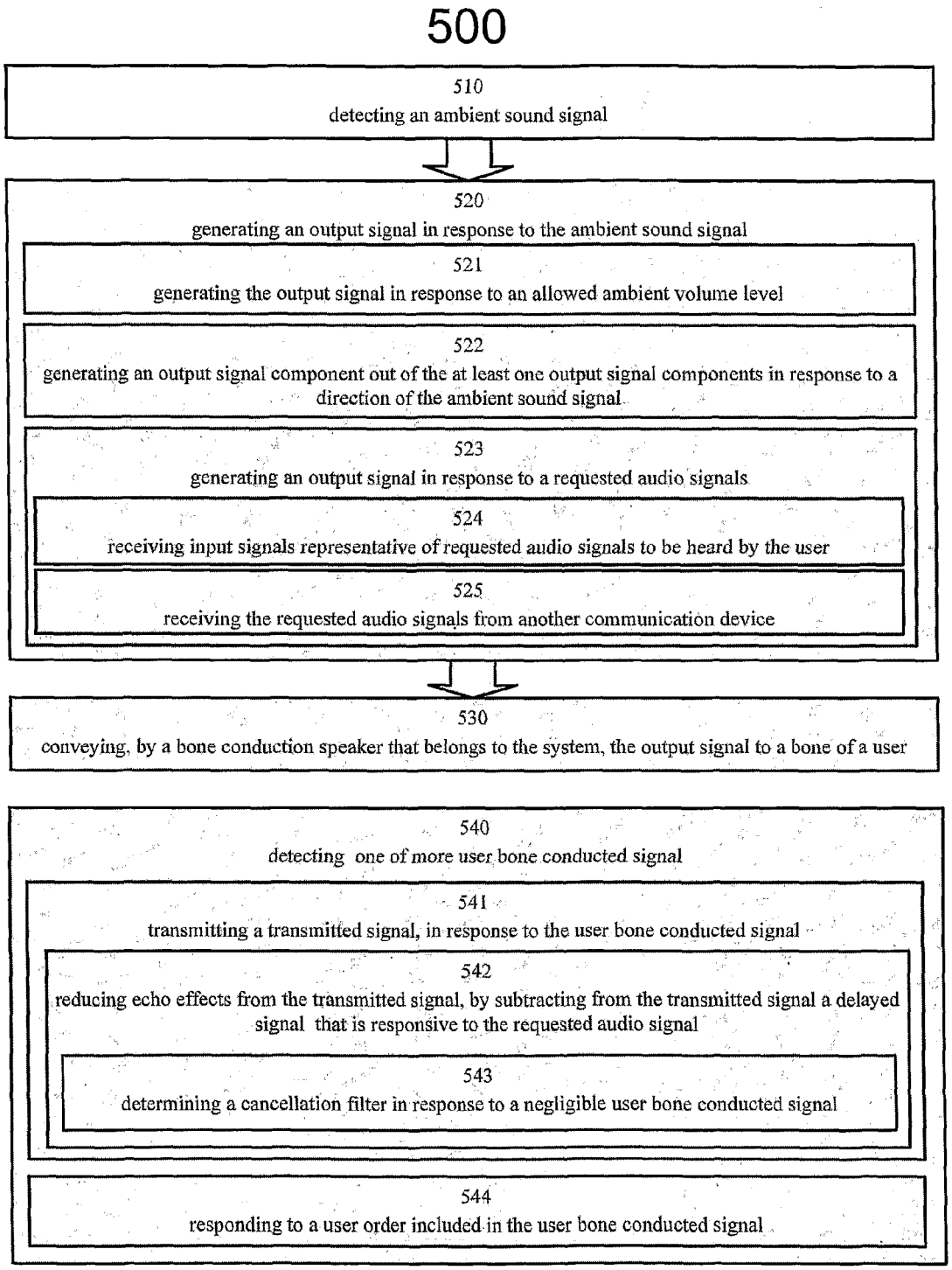
FIG. 8 illustrates a method for ambient sound reduction by a wearable ambient sound reduction system.

FIG. 8 illustrates method 500 for ambient sound reduction by a wearable ambient sound reduction system.

Method 500 starts with stage 510 of detecting an ambient sound signal. Conveniently the detecting includes detecting ambient sound signal that is included in a sound spectrum, and especially an ambient sound signal that is included in the entire audible sound spectrum. The detecting is conveniently carried out by one or more microphones that belong to a wearable ambient sound reduction system. It is noted that according to an embodiment of the invention, the wearable ambient sound reduction system is a concealable compact system, adapted to be worn by a user, conveniently behind at least one of the ears though not necessarily so, in a discreet manner as to be almost inconspicuous.

Referring to the examples set forward in the previous drawings, the detecting is conveniently carried out by microphone 220.

Stage 510 is followed by stage 520 of generating an output signal in response to the ambient sound signal; wherein the output signal, when conveyed to a user's bone, reduces an affect that an ambient sound signal has upon the user. Preferably, the amplitude of the output signal corresponds to the amplitude of the ambient sound signal wherein the phase of the output signal is reversed and properly delayed to the phase of the ambient sound signal. The correlation between the amplitudes of the output signal and the ambient sound signal is responsive to differences between anatomical receptivity parameters of sound signals and of bone conduction signals.

Referring to the examples set forward in the previous drawings, the generating is conveniently carried out by processor 210.

According to an embodiment of the invention, stage 520 includes stage 521 of generating the output signal in response to an allowed ambient volume level. Conveniently, the allowed ambient volume level is determined by the user, but not necessarily so. In some situations, the user may wish only to partially reduce the affect that the ambient sound has on himself (i.e. to dampen outside sound or noise to the allowed ambient volume level). Conveniently, the output signal correlates only to ambient sound signals that are louder than the allowed ambient volume level, so as to quieten said signals to a level in which they comply with the allowed ambient volume level.

According to an embodiment of the invention, stage 521 includes generating the output signal by respectively reducing the amplitude of all or most of the frequencies of the ambient sound signal, in response to the allowed ambient volume level.

According to an embodiment of the invention, stage 521 includes generating the output signal in response to an ambient volume audio filter, such as a high pass filter, low pass filter, band pass filter, band stop filter and so forth. The generating of the output signal in response to the ambient volume audio filter is useful, by way of example only and not intending to limit the scope of the invention in any way, in situations in which the ambient sound includes sound arriving from one or more noise producers, characterized by a limited band of frequencies.

According to an embodiment of the invention, stage 520 includes generating the output signal in response to an output volume audio filter, which is further useful, by way of example only and not intending to limit the scope of the invention in any way, in order to manipulate the output signals in order so as to provide the user a certain sound experience (such as resembling a rock music sound scheme, classical music sound scheme, movie palace sound scheme, and so forth).

According to an embodiment of the invention, the output volume audio filter is used in order to correct a perception distortion derived from different conduction profile of bone conduction and of air conducted vibrations hearing. As an example only, and not intending to limit the scope of the invention in any way, it is known to any person skilled in the art that low frequencies are transmitted better by bones then higher frequencies, thus leading for the perception of sound by the user as having a much lower pitch than it truly has, a problem which could be mended by a dedicated correction filter.

According to an embodiment of the invention, stage 520 includes stage 522 of generating an output signal component out of the at least one output signal components in response to a direction of the ambient sound signal. In some situations it is desirable to reduce only a portion of the ambient sound arriving to the user from one or more specific direction, such as to reduce sound arriving from a specific noise producer while keeping sounds arriving from other directions unimpaired. Conveniently, stage 522 is facilitated by using an adaptable directional microphone, enabling the user to easily change the detection direction of the adaptable directional microphone.

According to an embodiment of the invention, stage 522 is carried out without moving the wearable ambient sound reduction system, which is conveniently achieved by using a group of microphones, and applying a different phase shift to the sound signal detected by each of the microphones of the group of microphones.

According to an embodiment of the invention, stage 520 includes stage 523 of generating the output signal in response to a requested audio signals, wherein stage 523 further includes stage 524 of receiving input signals representative of requested audio signals to be heard by the user, wherein the receiving precedes the generating of the output signal in response to a requested audio signals. As an example only, and not intending to limit the scope of the invention in any way, the requested audio signals may be music, speech, sounds generated by a computer program, and so forth.

Conveniently, stage 524 includes receiving the input signals from an external system. As an example only, and not intending to limit the scope of the invention in any way, the external system may be a portable audio player, an audio system, a computer, and so forth. According to an embodiment of the invention, stage 523 includes generating at least a portion of the output signals in response to requested audio data provided by the wearable ambient sound reduction system.

Conveniently, the output signal generated during stage 523, when conveyed to a bone of the user, facilitates a perception of the requested audio signal while reducing an affect that the ambient sound signal has upon the user.

According to an embodiment of the invention, stage 523 includes stage 525 of receiving the requested audio signals from another communication device. As an example only, and not intending to limit the scope of the invention in any way, the other communication device may be a cellular phone or mobile phone, a personal digital assistant, a portable two-way radio, and so forth.

According to an embodiment of the invention, the receiving of at least one of stages 524 and 525 is carried out wirelessly.

Referring to the examples set forward in the previous drawings, the receiving is carried by processor 210 from external system 410 or from communication device 420, and, according to an embodiment of the invention, by communication unit 260 and especially via antenna 266 or via data cable 261.

According to an embodiment of the invention, method 500 includes stage 530 of conveying, by a bone conduction speaker belonging to the system, the output signal to a bone of a user. Conveniently, the conveying is carried out by at least one bone conduction speaker that belongs to the wearable ambient sound reduction system. It is noted that different bone conduction speakers may be placed so as to convey the output signals to bones in different body parts of the user. Conveniently, at least some of the bone conductivity speakers are placed so as to convey the output signal components to the user's skull bones.

Referring to the examples set forward in the previous drawings, the conveying is carried out by bone conduction speaker 230.

According to an embodiment of the invention, stage 530 further includes by at least one acoustic speaker, an output signal to an ear of the user. According to an embodiment of the invention, the bone conduction speakers and the at least one acoustic speaker are arrayed so as to stimulate an encompassing sound perception of the user; wherein the output signal is responsive both to the ambient sound signal and to the requested audio signal.

Referring to the examples set forward in the previous drawings, the conveying by the at least one acoustic speaker is carried out by acoustic speaker 240.

It is noted, that according to an embodiment of the invention that includes multiple bone conduction speakers, the detecting of the ambient sound signals is carried out by multiple microphones that are associated with the different bone conduction speakers, in order to generate a different output signal for different bone conduction speakers, according to the respective ambient sound signals. According to an embodiment of the invention that includes multiple bone conduction speakers, the wearable ambient sound reduction system includes multiple processors that are connected to the different bone conductivity speakers, wherein each processor is adapted to generate one or more output signals to be conveyed to the user by different bone conduction speakers.

According to an embodiment of the invention, method 500 includes stage 540 of detecting one or more user bone conducted signal, wherein the user bone conducted signal is a bone conduction signal that vibrates a sampled bone of the user. Conveniently, the user bone conducted signal is responsive to voices, and especially to speech, produced by the user. It is noted that on many occasions, the bone conduction signal is also responsive to additional vibrations of the sampled bone of the user, and specifically also to bone conduction signals applied to the sampled bone, such as the output signal of method 500. A method to reduce the impact of the additional vibrations on the user bone conduction signal is hereby described.

Referring to the examples set forward in the previous drawings, the detecting of the one or more bone conducted signal is carried out by bone conduction microphone 250.

Stage 540 includes stage 541 of transmitting a transmitted signal, in response to the user bone conducted signal, which, according to an embodiment of the invention, is carried out at least partially concurrently to the receiving of stages 524 and 525 (a feature of communication systems conventionally referred to as full-duplex communication). Conveniently, the transmitted signal is transmitted to an external system, which can be, though not necessarily so, a communication device, and especially the communication device of stage 525. According to an embodiment of the invention, the transmitting is carried out wirelessly.

Referring to the examples set forward in the previous drawings, the transmitting is carried out by processor 210 to external system 410 or to communication device 420, and, according to an embodiment of the invention, by communication unit 260 and especially via antenna 266 or via data cable 261.

According to an embodiment of the invention, stage 541 includes stage 542 of reducing echo effects from the transmitted signal, by subtracting from the transmitted signal a delayed signal that is responsive to the requested audio signals.

According to an embodiment of the invention, stage 542 includes stage 543 of determining a cancellation filter in response to a negligible user bone conducted signal; wherein the reducing of stage 541 is responsive to the cancellation filter.

The user bone conducted signal is responsive to vibrations of the sampled bone that are resulting from: (a) a user sound signal produced by a user (and especially to a speech of the user); and (b) the output signals. The user bone conducted signal is further responsive to an impulse response of the sampled bone.

Since, as put forward herein, the user bone conducted signal is responsive to the output signal, and hence also to the requested audio signals, it is clear to any person skilled in the art that, practically, during the detecting of the user bone conducted signal, the wearable ambient sound reduction system detects echoes of the output signals (and hence also of the requested audio signal) that the wearable ambient sound reduction system itself has conveyed to the sampled bone.

It is noted that the detected user bone conducted signal is also responsive to noises generated by to the wearable ambient sound reduction system. The explanation offered herein is neglecting the noises generated by to the wearable ambient sound reduction system, which are minute in embodiments of the invention that implement digital signal processing, but it is a straight-forward procedure for any person skilled in the art to make the proper adaptations to embodiments of the invention in which it is desirable to refer to at least a portion of the noises generated by the wearable ambient sound reduction system.

As both the user bone conducted signal and the requested audio signals are available to the system, it is desirable to determine a cancellation filter, that when applied to the requested audio signals, will facilitate the cancellation of the echoes, and thus obtaining a filtered signal which better correlates to the user sound signal.

In a notation in which (a) MUBCS(n) denotes the user bone conducted signal after being initially manipulated by the wearable ambient sound reduction system; (b) RAS(n) denotes the requested audio signals; (b) CF(n) denotes the cancellation filter; (d) FS(n) denotes the filtered signal; and (e) USS(n) denotes the user sound signal, it is understood to any person skilled in the art that the result of a the reducing of the echo effects of stage 542 can be written as follows, wherein the asterisk symbol represent a convolution operation:

$$FS(n)=MUBCS(n)-RAS(n)*CF(n) \quad \text{(xvii)}$$

Wherein, in a notation in which (a) MRAS(n) denotes a manipulated requested audio signals; (b) IR(n) denotes the impulse response of the sampled bone; and (c) IMF(n) denotes one or more initial manipulation filters applied to the user bone conducted signal, $$MUBCS(n)=[USS(n)+MRAS(n)]*IR(n)*IMF(n) \quad \text{(xviii)}$$

Wherein, in a notation in which RASMF(n) denotes one or more requested audio signal manipulation filters, that are applied to the requested audio signal during the generating, $$MRAS(n)=RAS(n)*RASMF(n) \quad \text{(xix)}$$

It is desirable to determine, in the determining of the cancellation filter, a cancellation filter that will statistically minimize the differences between the filtered signal and the user sound signal, and following the same notation, according to an embodiment of the invention, the minimizing is carried out so that the following expression is minimal (wherein E{ } presents the statistical average):

$$E\{[FS(n)-USS(n)]^2\}=E\{[MUBCS(n)-RAS(n)*CF(n)-USS(n)]^2\} \quad \text{(xx)}$$

As an example only intended to clarify the invention, and not intending to limit the scope of the invention in any way, presuming that the cancellation filter is stationary (i.e. is constant for different requested audio signals), the calculation of the cancellation filter is easily carried out if the user sound signal is negligible (i.e. USS(n)≈0), for expression (iv) than equals to:

$$E\{[MUBCS(n)-RAS(n)*CF(n)]^2\} \quad \text{(xxi)}$$

And equations (xviii) and (xix) are than reduced to:

$$MUBCS(n)=RAS(n)*RASMF(n)*IR(n)*IMF(n) \quad \text{(xxii)}$$

Hence, expression (xx), that ought to be minimized, is equal to:

$$E\{[RAS(n)*RASMF(n)*IR(n)*IMF(n)-RAS(n)*CF(n)]^2\} \quad \text{(xxiii)}$$

The minimum of expression (xxiii) is obviously obtained when:

$$CF(n)=RASMF(n)*IR(n)*IMF(n) \quad \text{(xxiv)}$$

Since RASMF(n) and IMF(n) are known filters of the wearable ambient sound reduction system, the only unknown parameter that is requested in order to determine the cancellation filter is the impulse response of the sampled bone. When the user sound signal is negligible, from equation (xxii) it is easily understood by any person skilled in the art, that by applying one or more dedicated requested audio signals to the sampled bone, one can deduct the impulse response of the sampled bone from the user bone conducted signal that is detected, and hence also the cancellation filter needed.

It is noted that it is not necessary for the user to maintain absolute silence during the determining of the cancellation filter. According to an embodiment of the invention, stage 543 includes detecting one or more silence periods, which are common in normal speech conversation (e.g. by a simple energy detector that detects an energy of the user bone conducted signal). Once a silence period has been detected, the user sound signal can be eliminated for a short period (for example one that lasts few milliseconds), conveniently by the shutting off of a microphone for the duration of that short period.

According to an embodiment of the invention, in order to increase the accuracy of the calibration filter, the detecting is repeated a few consecutive times. According to an embodiment of the invention, the cancellation filter is redetermined from time to time in situations in which it facilitates an effective reduction of echo (e.g. when the impulse response of the sampled bone varies, such as, as an example only, when a relative movement between the wearable ambient sound reduction system and the sampled bone occurs).

Referring to the examples set forward in the previous drawings, stages 542 and 543 are carried out by processor 210, and according to an embodiment of the invention, by echo reduction unit 280.

According to an embodiment of the invention, stage 540 includes stage 544 of responding to a user order included in the user bone conducted signal.

It is noted that according to different embodiments of the invention, stage 540 may come either before stage 510, follow stage 530, come between stages 510 and 520 or between stages 520 and 530, be concurrent with one or more of 510, 520 and 530 stages, or any combination of the above.

According to different embodiments of the invention, method 500 includes the detecting, processing and conveying of signals which are either analog signals or digital signals. It is noted that some embodiments includes the detecting, processing and conveying of both analog and digital signals, wherein method 500 further comprises at least one stage of converting analog signal to a digital signal and/or stage of converting digital signal to an analog signal.

Figure 9:
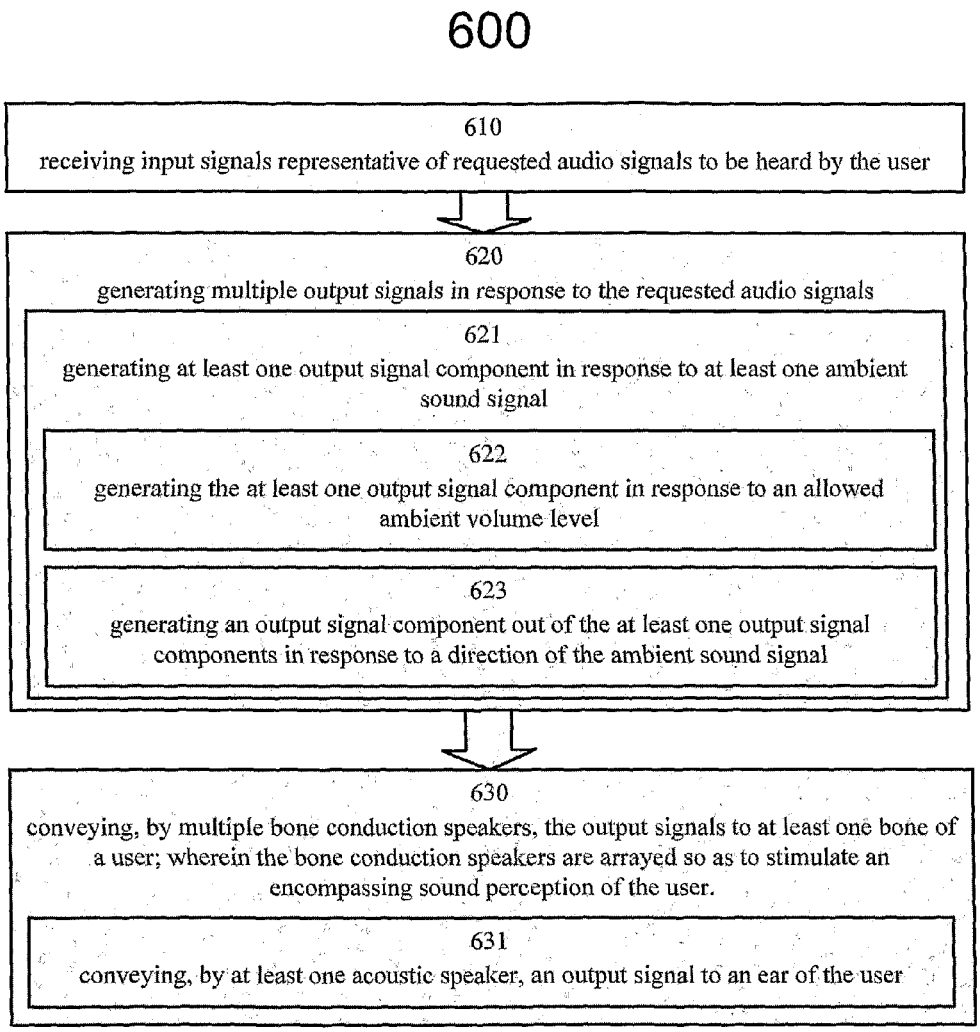
FIG. 9 illustrates a method for conveying surround sound to a user.

FIG. 9 illustrates method 600 for conveying surround sound to a user.

Method 600 starts with stage 610 of receiving input signals representative of requested audio signals to be heard by the user. As an example only, and not intending to limit the scope of the invention in any way, the requested audio signals may be music, speech, sounds generated by a computer program, and so forth. Conveniently, the requested audio signals are interrelated so as to represent surround sound, but not necessarily so.

Conveniently, stage 610 includes receiving the input signals from an external system. As an example only, and not intending to limit the scope of the invention in any way, the external system may be a portable audio player, an audio system, a computer, and so forth. Conveniently the external system has surround sound capabilities, but not necessarily so.

According to an embodiment of the invention, the receiving includes receiving the input signals from multiple sources.

According to an embodiment of the invention, the receiving of stage 610 is carried out wirelessly or in a wired manner.

Stage 610 is followed by stage 620 of generating multiple output signals in response to the requested audio signals. Conveniently, the multiple output signals are interrelated, so as to stimulate an encompassing sound perception of a user when conveyed to the user by a wearable surround sound system. According to an embodiment of the invention, at least one output signal component is not interrelated with at least one other output signal component.

Referring to the examples set forward in the previous drawings, the generating is carried out by processor 310.

According to an embodiment of the invention, stage 620 includes stage 621 of generating at least one output signal component in response to at least one ambient sound signal;

wherein at least one output signal component, when conveyed to a bone of the user, reduces an affect of the ambient sound signal upon the user.

Referring to the examples set forward in the previous drawings, the detecting of the ambient sound signal is carried out by microphone 320.

According to an embodiment of the invention, stage 621 includes stage 622 of generating the at least one output signal component in response to an allowed ambient volume level. Conveniently, the allowed ambient volume level is determined by the user, but not necessarily so. In some situations, the user may wish only to partially reduce the affect that the ambient sound has upon himself (i.e. to dampen surrounding sound or noise to the allowed ambient volume level).

Conveniently, the output signal correlates only to ambient sound signals that are louder than the allowed ambient volume level, so as to quieten said signals to a level in which they comply with the allowed ambient volume level.

According to an embodiment of the invention, stage 621 includes generating the output signals by respectively reducing the amplitude of all or most of the frequencies of the ambient sound signal, in response to the allowed ambient volume level.

According to an embodiment of the invention, stage 621 includes generating the output signals in response to an ambient volume audio filter, such as a high pass filter, low pass filter, band pass filter, band stop filter and so forth. The generating of the output signal in response to the ambient volume audio filter is useful, by way of example only and not intending to limit the scope of the invention in any way, in situations in which the ambient sound includes sound arriving from one or more noise producers, characterized by a limited band of frequencies.

According to an embodiment of the invention, stage 620 includes generating the output signals in response to an output volume audio filter, which is further useful, by way of example only and not intending to limit the scope of the invention in any way, in order to manipulate the output signals in order so as to provide the user a certain sound experience (such as resembling a rock music sound scheme, classical music sound scheme, movie palace sound scheme, and so forth).

According to an embodiment of the invention, the output volume audio filter is used in order to correct a perception distortion derived from different conduction profile of bone conduction and of air conducted vibrations hearing. As an example only, and not intending to limit the scope of the invention in any way, it is known to any person skilled in the art that low frequencies are transmitted better by bones then higher frequencies, thus leading for the perception of sound by the user as having a much lower pitch than it truly has, a problem which could be mended by a dedicated correction filter.

According to an embodiment of the invention, stage 621 includes stage 623 of generating an output signal component out of the at least one output signal components, in response to a direction of the ambient sound signal. In some situations it is desirable to reduce only a portion of the ambient sound that arrives to the user from one or more specific direction, such as to reduce sound that is arriving from a specific noise producer while keeping sounds that are arriving from other directions unimpaired. Conveniently, stage 623 is facilitated by using an adaptable directional microphone, enabling the user to easily change the detection direction of the adaptable directional microphone.

According to an embodiment of the invention, stage 623 is carried out without moving the wearable surround sound system, which is conveniently achieved by using at least one group of microphones, and applying a different phase shift to the sound signal detected by each of the microphones of the group of microphones.

According to an embodiment of the invention, stage 620 includes generating at least a portion of the output signals in response to requested audio data provided by the wearable surround sound system.

Stage 620 is followed by stage 630 of conveying, by multiple bone conduction speakers, the output signals to at least one bone of a user; wherein the bone conduction speakers are arrayed so as to stimulate an encompassing sound perception of the user.

Referring to the examples set forward in the previous drawings, the conveying is carried out by bone conduction speakers 330.

It is noted that different bone conduction speakers may be placed so as to convey the output signals to bones in different body parts of the user. Conveniently, at least some of the bone conductivity speakers are placed so as to convey the output signal components to the user's skull bones.

According to an embodiment of the invention, stage 630 includes stage 631 of conveying, by at least one acoustic speaker, an output signal to an ear of the user; wherein the bone conduction speakers and the at least one acoustic speaker are arrayed so as to stimulate an encompassing sound perception of the user.

Referring to the examples set forward in the previous drawings, the conveying of stage 631 is carried out by at least one acoustic speaker 340.

As an example only, and not intending to limit the scope of the invention in any way, according to an embodiment of the invention, in order to get four channels surround sound, the conveying includes using: (a) two bone conduction speakers that are placed behind the ears of the user, and (b) two acoustic speakers that convey output signal components to the ears of the user.

As an example only, and not intending to limit the scope of the invention in any way, according to an embodiment of the invention, in order to get five channels surround sound, the conveying includes using: (a) two bone conduction speakers that are placed behind the ears of the user, (b) two acoustic speakers that convey output signal components to the ears of the user, and (c) a bone conduction speaker that is placed near the forehead or on another point on the head.

As an example only, and not intending to limit the scope of the invention in any way, according to an embodiment of the invention, in order to get 5.1 channels, the conveying includes using: (a) two bone conduction speakers that are placed behind the ears of the user, (b) two acoustic speakers that convey output signal components to the ears of the user, (c) a bone conduction speaker that is placed near the forehead or on another point on the head, and (d) a bone conduction speaker adapted to perform as a subwoofer speaker, placed in other location on the head or on the body of the user.

According to different embodiments of the invention, method 600 includes the detecting, processing and conveying of signals which are either analog signals or digital signals. It is noted that some embodiments includes the detecting, processing and conveying of both analog and digital signals, wherein method 600 further comprises at least one stage of converting analog signal to a digital signal and/or stage of converting digital signal to an analog signal.

The present invention can be implemented by employing conventional tools, methodology and components. Accordingly, the details of such tools, component and methodology are not set forth herein in detail. In the previous descriptions, numerous specific details are set forth, in order to provide a thorough understanding of the present invention. However, it should be recognized that the present invention might be practiced without resorting to the details specifically set forth.

Only sample embodiments of the present invention and but a few examples of its versatility are shown and described in the present disclosure. It is to be understood that the present invention is capable of use in various other combinations and environments and is capable of changes or modifications within the scope of the inventive concept as expressed herein.

I claim:

1. A wearable surround sound system, the system comprises:

a processor, adapted to receive input signals representative of requested audio signals to be heard by the user and in response to generate multiple output signals;

multiple bone conduction speakers, coupled to the processor, adapted to convey the multiple output signals to at least one bone of a user; wherein the bone conduction speakers are arrayed so as to stimulate an encompassing sound perception of the user; and a microphone, coupled to the processor, that is adapted to detect an ambient sound signal; wherein the processor is further adapted to generate the multiple output signals in response to the ambient sound signal; wherein at least one output signal component, when conveyed to a bone of the user, reduces an affect of the ambient sound signal upon the user.

2. The system according to claim 1, wherein the processor is arranged to generate the multiple output signals in correlation to the ambient sound signal only when the ambient sound signal is louder than an allowed ambient volume level so as to quieten the ambient sound signal to a level in which the ambient sound signal complies with the allowed ambient volume level.

3. The system according to claim 1, comprising multiple microphones, at least some of the multiple microphones form a group of microphones that facilitates a detection of ambient sound that arrives to the user from one or more specific direction without moving the system, by applying a different phase shift to sound signal detected by each of the microphones of the group of microphones.

4. The system according to claim 1, wherein the processor is further adapted to generate an output signal component out of the at least one output signal component, in response to a direction of the ambient sound signal.

5. The system according to claim 1, wherein the processor is adapted to generate the at least one output signal component in response to an allowed ambient volume level.

6. A method for conveying surround sound to a user, the method comprises: receiving input signals, representative of requested audio signals to be heard by the user; generating multiple output signals, in response to the requested audio signals; and conveying, by multiple bone conduction speakers, the output signals to at least one bone of a user; wherein the bone conduction speakers are arrayed so as to stimulate an encompassing sound perception of the user; wherein the generating comprises generating the output signals in response to an ambient sound signal detected by a microphone; wherein at least one output signal component, when conveyed to a bone of the user, reduces an affect of the ambient sound signal on the user.

7. The method according to claim 6, wherein the generating comprises generating the multiple output signals in correlation to the ambient sound signal only when the ambient sound signal is louder than an allowed ambient volume level so as to quieten the ambient sound signal to a level in which the ambient sound signal complies with the allowed ambient volume level.

8. The method according to claim 6, comprising detecting ambient sound that arrives to the user from one or more specific direction without moving a wearable surround system that comprises a group of microphones, by applying a different phase shift to sound signal detected by each of the microphones of the group of microphones.

9. The method according to claim 6, wherein the generating comprises generating the output signal component in response to a direction of an ambient sound signal.

10. The method according to claim 6, wherein the generating comprises generating the output signal component in response to an allowed ambient volume level.

* * * * *